US006234081B1

(12) United States Patent
Neyer

(10) Patent No.: US 6,234,081 B1
(45) Date of Patent: May 22, 2001

(54) SHAPED BRIDGE SLAPPER

(75) Inventor: Barry T. Neyer, Cincinnati, OH (US)

(73) Assignee: EG&G, Inc., Wellesley, MA (US)

( * ) Notice: Subject to any disclaimer, the term of this patent is extended or adjusted under 35 U.S.C. 154(b) by 0 days.

(21) Appl. No.: 09/272,425

(22) Filed: Mar. 19, 1999

(51) Int. Cl.[7] ..... F42C 19/12

(52) U.S. Cl. ..... 102/202.5; 102/202.5; 102/200; 102/202.7

(58) Field of Search ..... 102/202.5, 200, 102/202.7

(56) References Cited

U.S. PATENT DOCUMENTS 4,471,696 * 9/1984 McCormick et al. ..... 102/202.14
4,852,493 * 8/1989 Boberg et al. ..... 102/202.5
4,862,803 * 9/1989 Nerheim et al. ..... 102/202.5
5,370,054 * 12/1994 Reams et al. ..... 102/202.5
5,789,697 * 8/1998 Engelke et al. ..... 102/202.5
5,969,286 * 10/1999 Ward et al. ..... 102/202.7

* cited by examiner

*Primary Examiner*—Michael J. Carone
*Assistant Examiner*—Lulit Semunegus
(74) *Attorney, Agent, or Firm*—Kirk Teska Iandiorio & Teska

(57) ABSTRACT

A shaped bridge slapper having a pair of spaced conductive lands on a substrate; a bridge member between the spaced conductive lands, the bridge member having a curved shape and a cavity herein, and a flyer layer extending over the bridge member.

15 Claims, 2 Drawing Sheets

SHAPED BRIDGE SLAPPER

FIELD OF INVENTION

This invention relates generally to devices for setting off an explosive charge and more particularly to a slapper type detonator with a shaped bridge member.

BACKGROUND OF INVENTION

Slapper type detonators in general cause a "flying plate" to be propelled at a high velocity against a secondary explosive medium creating a shock wave which results in the detonation of the secondary explosive. In a typical design, there are two wide area conductive lands separated by a narrow rectangular bridge member. The lands are connected to a capacitor through a high voltage switch. When the switch closes, the capacitor provides current across the lands which vaporizes the bridge member turning it into a plasma. This plasma accelerates a portion of the dielectric material covering the bridge member to a high velocity, causing it to slap into an explosive. The resulting shock wave causes detonation of the explosive.

Conventional slappers have a rectangular bridge which results in rectangular flying plates, the center of which leads the edges in flight. It has been discovered by the inventor of the subject invention, however, that this rectangular shape results in adverse edge effects which render the detonator inefficient.

SUMMARY OF INVENTION

It is therefore an object of this invention to provide a specially shaped bridge slapper which is more efficient than prior art slapper detonator designs with rectangular bridge members.

It is a further object of this invention to provide such a shaped bridge slapper which produces a larger shock wave than prior art designs.

It is a further object of this invention to provide such a shaped bridge slapper which requires less energy than conventional designs to provide the same shock.

It is a further object of this invention to provide such a shaped bridge slapper which can be made smaller than conventional designs.

This invention results from the realization that slapper type explosive detonator can be made more efficient and produce a larger shock wave to detonate an explosive by modifying the bridge member of the slapper to produce a curved shaped (e.g. circular) flying plate instead of the rectangular flying plate of conventional designs.

This invention features a shaped bridge slapper comprising a substrate, a pair of spaced conductive lands on the substrate, a bridge member typically extending between the spaced conductive lands, the bridge member having a curved shape and a cavity therein, and a flyer layer extending over the bridge member.

The curved bridge member is preferably circular in shape. The cavity may extend through the bridge member or may instead be an area of different material thickness. The cavity may also be filled with a material different than the material of the remainder of the bridge member.

The substrate may be ceramic and the lands and the bridge member may be made of copper. The flyer layer is typically made of a dielectric material such as polyimide.

In another design, the substrate is a face plate and the flyer layer is an epitaxial layer grown on a silicon substrate which is back etched in a zone beneath the bridge member. In another design, the slapper is an exploding foil initiator and the bridge member and the lands are foil. In this embodiment, the flyer layer is a layer of Kapton.

More broadly, this invention features a shaped bridge slapper comprising a substrate, a pair of spaced conductive lands on the substrate, a bridge member between the spaced conductive lands, the bridge member having a curved shape, and a flyer layer extending over the bridge member. Therefore, in this design there is no cavity of any kind in the bridge member. Alternatively, the shaped bridge slapper comprises a substrate, a pair of spaced conductive lands on the substrate, a bridge member between the spaced conductive lands, the bridge member having an outer conductive area and an inner area of reduced or different thickness and/or different material; and a flyer layer extending over the bridge member. Therefore, in this embodiment the bridge member may even have a conventional rectangular shape but includes a cavity therein, and/or a material such as "Kapton" or another dielectric filling the cavity. In the preferred embodiment, however, the bridge member is both circular in shape and includes a cavity therein.

DISCLOSURE OF PREFERRED EMBODIMENT

Other objects, features and advantages will occur to those skilled in the art from the following description of a preferred embodiment and the accompanying drawings, in which.

Figure 1:
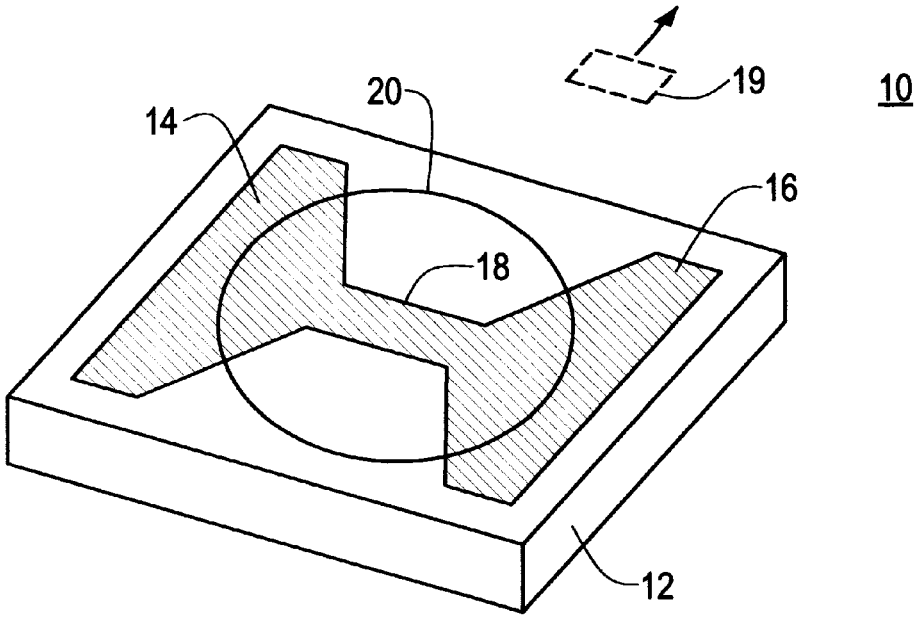
FIG. 1 PRIOR ART
FIG. 1 is a perspective view of a prior art chip slapper detonator.

Conventional "chip" slapper 10, FIG. 1 includes ceramic substrate 12 upon which is deposited metal film such as copper etched into the shape of spaced conductive lands 14 and 16 and rectangular bridge member 18 extending therebetween.

"Flyer" layer 20 (shown in FIG. 1 to be transparent for illustrative purposes), for example, a dielectric coating such as polyimide or "Kapton", is applied over bridge member 18 as shown.

In use, lands 14 and 16 are connected to a suitable voltage source and when several thousands volts are applied to the lands, bridge member 18 vaporizes and is turned into a plasma. This plasma accelerates a portion 19 of flyer layer ("the flying plate") away from substrate 12 and towards an explosive. The shock of flying plate 19 striking the explosive detonates the explosive.

Flying plate 19 of this conventional design, however, is rectangular and it has been discovered that this rectangular shape results in an inefficient chip slapper design. First, the rectangular shape results in adverse edge effects which render the detonator inefficient. Second, the center of the flying plate tends to lift first upon initiation and the edges then trail the center portion during its trajectory causing a diverging shock wave.

Another conventional rectangular bridge member slapper is shown in U.S. Pat. No. 4,862,803 incorporated herein by this reference.

Figure 2:
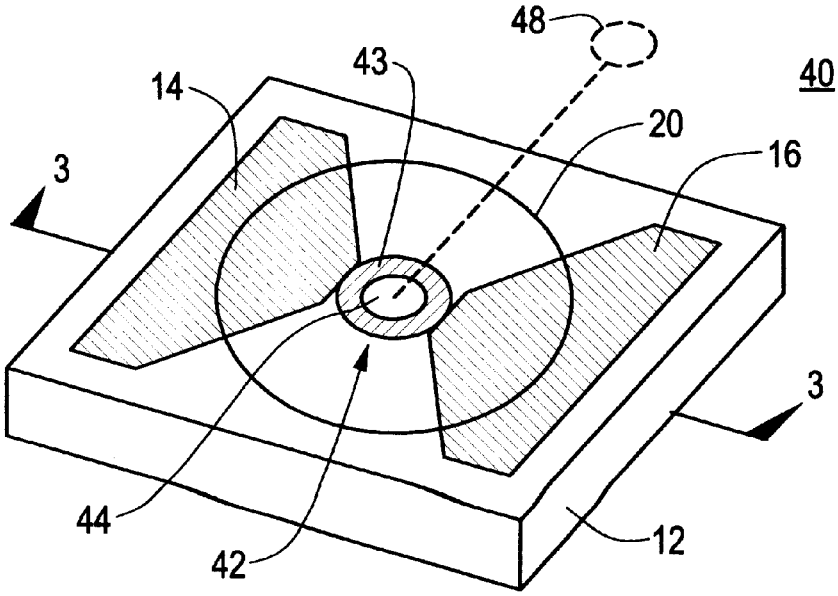
FIG. 2 is a perspective view of the shaped bridge slapper in accordance with the subject invention.
Figure 3:
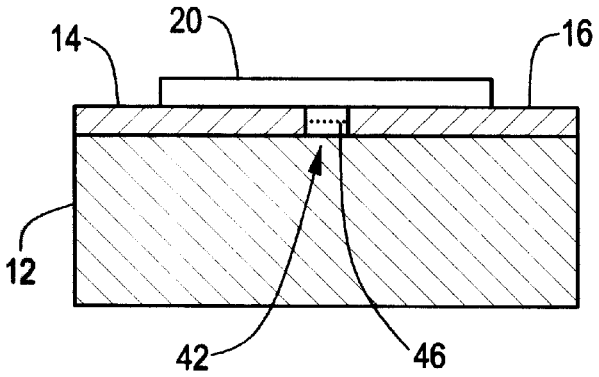
FIG. 3 is a cross-sectional view of the chip slapper of the subject invention taken along the line 3—3 in FIG. 2.

In chip slapper 40 of this invention, FIGS. 2 and 3, substrate 12 and flyer layer 20 are conventional as described above as are lands 14 and 16. Conductive (e.g., copper) bridge member 42, however, has a curved shape as shown, typically a circle. Also, curved bridge member 42 preferably includes cavity 44 therein which may extend all the way through the bridge member forming a hole or may instead form an area of different thickness and/or different material. An area of reduced thickness, for example, is shown by dashed line 46, FIG. 3. Cavity 44, FIG. 2 may be filled with a dialectic material such as "Kapton" as shown at 45, FIG. 4. Thus, bridge member 42 has outer area 43 and inner area 44 which may be of reduced or different thickness and/or of a material different than the conductive material of outer area 43.

When a current vaporizes bridge 42, FIG. 2, a curved edge, preferably circular shaped flying plate 48 is produced. Because a circle shape has the smallest perimeter for a given mass, or area, circular shaped flying plate 48 is more efficient than the rectangular flying plates produced with conventional chip slappers. Lands 14 and 16 and bridge member 42 including cavity 44 may be formed by etching processes.

Moreover, in the prior art design shown in FIG. 1, the center of the flying plate lifts first upon initiation and the edges trail the center portion during its trajectory causing a diverging shock wave.

In contrast, cavity or hole 44 in bridge member 42, FIG. 2 of the present design causes the flying plate to be curved with the edges leading the center because there is less or no plasma driving the inner surface and thus the flying plate tends to stick to the substrate until the plasma generates enough pressure to lift it completely off the substrate. The flying plate with the curved edges leading the center results in a shock wave focused to a higher pressure than in prior art designs.

Thus, the advantage of the circular shaped bridge shown in FIGS. 2 and 3 is that for a given energy input to the chip slapper device, it is able to provide a larger shock wave to detonate an explosive. Conversely, less energy is required to provide the same shock wave to an explosive as in a conventional design. As a result, smaller chip slappers can be designed for specific implementations. Chip slapper 40, FIG. 2 can be used anywhere a conventional electro-explosive device is currently used including military, mining, automotive, and construction applications. Chip slapper 40 can also be used in environments where it is not currently practical to use electro-explosive devices because of the risk of inadvertent initiation due to high electromagnetic radiation environments.

Figure 5:
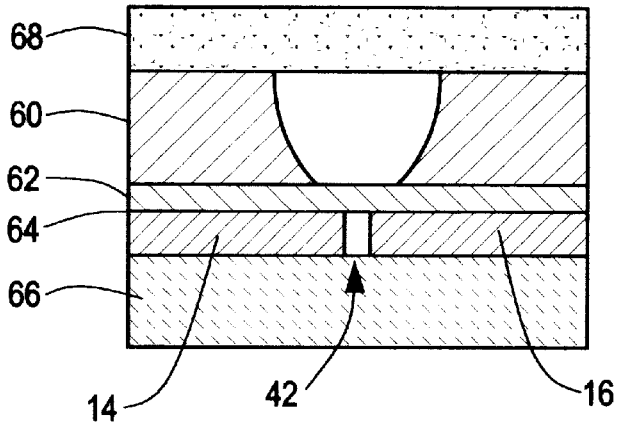
FIG. 5 is a cross-sectional view of another embodiment of the shaped bridge slapper of the subject invention.

In the embodiment shown in FIG. 5, the chip slapper design of U.S. Pat. No. 4,862,803 and equivalent designs is modified to include a curved shape bridge member as discussed with reference to FIGS. 2 and 3.

In this embodiment, layer 60 is a single crystal silicon substrate upon which is grown epitaxial layer 62. Insulating layer 64 is formed on the exposed surface of epitaxial layer 62.

Bridge member 42 similar to that shown in FIG. 2 and extends between lands 14 and 16 as shown on insulative layer 64 and face plate 66 now serves the function of a "substrate" 12, FIGS. 2 and 3 and the "flyer layer" is now epitaxial layer 62. Layer 60 may be back etched in the zone beneath bridge member 42 to allow the circular flying plate to strike secondary explosive pellet 68.

Figure 6:
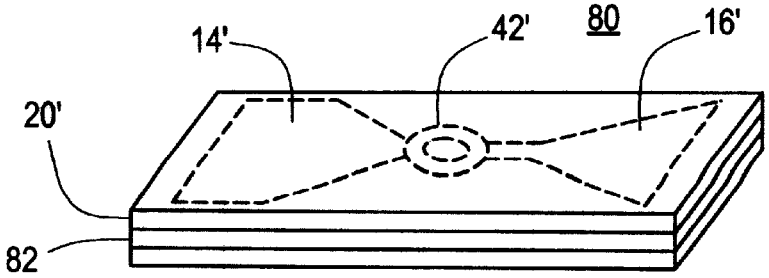
FIG. 6 is a perspective view of another embodiment of the shaped bridge slapper of the subject invention.

In the embodiment shown in FIG. 6, exploding foil initiator 80 includes curved shaped, (preferably circular) bridge member 42' of this invention. As is known in the art, exploding foil initiator 80 includes a layer of foil 82 in the shape of lands 14' and 16' and bridge member 42'. Flyer layer 20' is typically Kapton.

Figure 4:
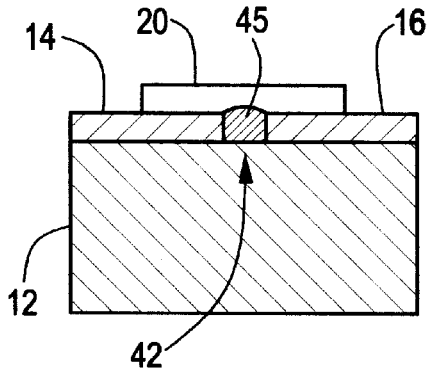
FIG. 4 is a cross-sectional view of another embodiment of the chip slapper of the subject invention.

Therefore, curved shaped bridge member 42, FIGS. 2, 3, and 4 may be employed with various chip slapper configurations including but not limited to those shown in FIGS. 5 and 6 in addition to the basic designs shown in FIGS. 2–4.

Also, although FIGS. 2–6 each show a bridge member with a circular shape and a cavity therein, this preferred embodiment is not a limitation of the subject invention. In some designs, only a curved shaped bridge member with no cavity may be desired. In still other designs, only a cavity may be desired, with or without a filler of some desired material and the curved bridge shape may not be required since both features independently yield a more efficient chip slapper design.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A shaped bridge slapper comprising:

a substrate;

a pair of spaced conductive lands on the substrate;

a bridge member between the spaced conductive lands, the bridge member having a curved shape and a cavity therein; and a flyer layer extending over the bridge member.

2. The slapper of claim 1 in which the bridge member is circular in shape.

3. The slapper of claim 1 in which the cavity extends through the bridge member.

4. The slapper of claim 1 in which the cavity is at least partially filled with a material different than the material of the bridge member.

5. The slapper of claim 1 in which the substrate is ceramic.

6. The slapper of claim 1 in which the lands and the bridge member are made of copper.

7. The slapper of claim 1 in which the flyer layer is made of a dielectric material.

8. The slapper of claim 7 in which the dielectric material is polyimide.

9. The slapper of claim 1 in which the substrate is a face plate.

10. The slapper of claim 1 in which the flyer layer is an epitaxial layer grown on a silicon substrate.

11. The slapper of claim 10 in which the silicon substrate is back etched in a zone beneath the bridge member.

12. The slapper of claim 1 in which the lands and the bridge member are made of foil.

13. The slapper of claim 12 in which the flyer layer is made of Kapton.

14. A shaped bridge slapper comprising:

a substrate;

a pair of spaced conductive lands on the substrate;

a bridge member between the spaced conductive lands, the bridge member having a curved shape; and a flyer layer extending over the bridge area.

15. A shaped bridge slapper comprising:

a substrate;

a pair of spaced conductive lands on the substrate;

a bridge member between the spaced conductive lands, the bridge member having a conductive outer area and an inner area of reduced thickness and/or different material; and a flyer layer extending over the bridge member.

* * * * *